US010517375B2

(12) United States Patent
Hoppa

(10) Patent No.: US 10,517,375 B2
(45) Date of Patent: Dec. 31, 2019

(54) BULK ITEM BACKPACK

(71) Applicant: Thomas Hoppa, Westminster, MD (US)

(72) Inventor: Thomas Hoppa, Westminster, MD (US)

( * ) Notice: Subject to any disclaimer, the term of this patent is extended or adjusted under 35 U.S.C. 154(b) by 0 days.

(21) Appl. No.: 14/082,892

(22) Filed: Nov. 18, 2013

(65) Prior Publication Data

US 2014/0209646 A1 Jul. 31, 2014

Related U.S. Application Data

(60) Provisional application No. 61/759,154, filed on Jan. 31, 2013.

(51) Int. Cl.

| | |
|---|---|
| ***A45F 3/00*** | (2006.01) |
| ***A45F 3/08*** | (2006.01) |
| ***A45F 3/04*** | (2006.01) |
| ***A45F 3/10*** | (2006.01) |

(52) U.S. Cl.

CPC ..... *A45F 3/08* (2013.01); *A45F 3/04* (2013.01); *A45F 3/10* (2013.01)

(58) Field of Classification Search

CPC ..... A45F 3/04; A45F 3/08; A45F 3/10
USPC ..... 224/261, 633, 634, 635, 636
See application file for complete search history.

(56) References Cited

U.S. PATENT DOCUMENTS 2,967,649 A * 1/1961 Mack et al. ..... 224/263
3,266,686 A * 8/1966 Griffith ..... A45F 4/02 224/155
3,307,758 A * 3/1967 Platt ..... A45F 4/02 224/155
4,480,775 A * 11/1984 Stanford ..... 224/635
4,577,901 A * 3/1986 Phillips ..... 297/17
4,720,029 A * 1/1988 Varanakis ..... 224/155
4,889,383 A * 12/1989 Jones ..... 297/16.1
5,031,811 A * 7/1991 Charest ..... 224/155
5,209,381 A * 5/1993 Jay ..... A45F 4/02 224/155
5,222,641 A * 6/1993 Medeiros, Jr. ..... A47D 13/025 224/161
D338,779 S 8/1993 Albert
5,297,708 A * 3/1994 Carpenter ..... A45F 4/02 224/155
5,381,941 A * 1/1995 Brune ..... 224/155
5,409,291 A * 4/1995 Lamb et al. ..... 297/129
5,536,064 A * 7/1996 MacLean ..... 297/129
(Continued)

*Primary Examiner* — Nathan J Newhouse
*Assistant Examiner* — Lester L Vanterpool
(74) *Attorney, Agent, or Firm* — Argus Intellectual Enterprise; Daniel Enea; Jordan Sworen

(57) ABSTRACT

Disclosed is a bulk item backpack composed of an upper frame portion and a lower frame portion that pivot with respect to one another and are adapted to carry a wide array of bulk cargo, including coolers. The backpack has a strap or plurality of straps to secure the backpack to the user, including a waist strap, shoulder straps, or both types of straps. Optionally the backpack may also include cargo straps for securing additional items, such as folding chairs or a storage box adapted for carrying loose items therein. The backpack of the present invention provides a frame that is ideally suited for simultaneously carrying bulky items and loose items that are difficult to carry at once and would normally require several trips.

14 Claims, 2 Drawing Sheets

(56) References Cited

U.S. PATENT DOCUMENTS

| | | | | | |
|---|---|---|---|---|---|
| 5,547,246 | A * | 8/1996 | Lambert | 297/129 | |
| 5,628,544 | A | 5/1997 | Goodman et al. | | |
| 5,868,462 | A * | 2/1999 | Truax | A45F 3/08 | 224/155 |
| 5,975,389 | A * | 11/1999 | Braun | A01M 31/02 | 182/187 |
| 6,000,752 | A | 12/1999 | Shyr | | |
| 6,056,172 | A * | 5/2000 | Welsh | 224/155 | |
| 6,662,981 | B2 * | 12/2003 | McUmber | 224/155 | |
| 6,986,445 | B1 | 1/2006 | Stockman | | |
| 2002/0088829 | A1 * | 7/2002 | Hsu | A45C 9/00 | 224/153 |
| 2007/0075105 | A1 * | 4/2007 | Petrin | 224/153 | |
| 2008/0061093 | A1 | 3/2008 | Pottharst | | |

* cited by examiner

BULK ITEM BACKPACK

CROSS REFERENCE TO RELATED APPLICATION

This application claims the benefit of U.S. Provisional Application No. 61/759,154 filed on Jan. 31, 2013, entitled "Back Pack Chair Cooler." The above identified patent application is herein incorporated by reference in its entirety to provide continuity of disclosure.

BACKGROUND OF THE INVENTION

Field of the Invention

The present invention relates to backpacks and backpack frames for carrying larger items. More specifically, the present invention relates to the field of backpacks adapted to transporting coolers and bulk items that are difficult to otherwise handle.

When at sporting events, concerts, or other outdoors events, people often want to have a cooler, a chair, and their cellphone or other small items with them. Unfortunately, it is often very difficult for an individual to carry by himself or herself a cooler, a folding chair, and several small, loose items at the same time. This is because coolers are often quite heavy, generally require both hands to carry, and are typically quite cumbersome. Certain types of folding chairs are also often bulky and awkward to carry along with other items. Finally, loose items such as cellphones and wallets are easily lost while attempting to juggle a cumbersome cooler and an awkwardly-shaped folding chair. Outdoors events also often have muddy or sandy ground, making footing precarious and further creating a frustrating experience.

Present technologies attempt to solve these problems in a variety of ways, mostly by combining two or more of the pack, the chair, and the cooler elements together. Backpacks that convert into chairs are increasingly common, but if the user does not like the specific chair that the backpack converts into, then the user is without an option. Chairs that have coolers attached to them have also been created, but the way they are designed it is often impossible to sit in the chair and retrieve something from the cooler at the same time, or the apparatus is extremely bulky. Additionally, these types of chairs share the same problems as the backpacks that convert into chairs in that the user may not find the included chair comfortable or aesthetically pleasing. No device successfully provides an individual with the option of choosing the cooler and the chair that he wishes, while at the same time allowing the user to carry these otherwise bulky items comfortably and easily together.

The present invention addresses the issue of bulk transport of coolers and chairs, while also providing storage of loose items. The user is free to choose any chair or cooler that he or she wishes and is not forced to use potentially uncomfortable chairs designed primarily for the purpose of turning into a backpack or poor-quality coolers that were designed with a wide-range of considerations in mind, with little attention paid to whether they were actually efficient at keeping food or beverages cold. Furthermore, there is a removable bag for storing small items, such as keys, cellphones, or wallets, which are easily lost while at muddy concert venues, beaches, or other such environments. Mostly importantly though, the present invention allows a user to carry all of these items at once with comfort and ease.

Description of the Prior Art

Devices have been disclosed in the prior art that relate to backpacks. These include devices that have been patented and published in patent application publications. These devices generally relate to backpacks adapted to carry chairs or backpacks that are adapted to convert into chairs. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 6,986,445 to Stockman and U.S. Published Patent Application Publication No. 2008/006,1093 to Pottharst both disclose backpacks that convert into chairs. In Pottharst the top of the backpack may be pulled up to reveal a seat. In Stockman a rigid chair may be unfurled from the portion of the backpack between the shoulder straps. These inventions have several drawbacks, however. First, the user must use the chair that comes with the backpack and may not use whatever chair they wish to. Second, these inventions still do not provide any means for transporting a cooler along with the chair. Thirdly, these inventions either provide an unsteady base upon which to sit, as with Pottharst, or they require some assembly, as with Stockman.

Another such device is U.S. Design Pat. No. D338,779 to Albert, which discloses a backpack that has a compartment that is specifically designed hold the back section of a folding chair, which secures the folding chair in place against the backpack. A major drawback of this design is that the end of the folding chair hangs down below the base of the backpack, potentially banging against the back of the user's legs during transport or otherwise interfering with the user's movement. Albert additionally does not incorporate a way to carry any bulk items, such as coolers, like the present invention does. Attempting to carry a bulk item, such as a cooler, while a folding chair bangs against one's legs would make for a very challenging walk across areas with poor footing.

U.S. Pat. No. 6,000,752 to Shyr discloses a folding chair with a built-in receptacle that can serve as a cooler. The top of the cooler is the seat of the chair and therefore it is impossible to sit on the chair and retrieve something from the cooler at the same time. There is also only one receptacle, so objects that need to be in a cooler and other loose objects, such as wallets and cellphones, cannot be carried at the same time without additional holders.

Finally, U.S. Pat. No. 5,628,544 to Goodman discloses another device that acts as a combination between a cooler and a chair, like Shyr, but uses a much different method. Goodman consists of two-thermally insulated containers that, when pulled apart, unfurl a lounge chair. The thermally-insulated containers act as the arm rests for the lounge chair. Like the previously discussed prior art, the user is forced to use the chair that is associated with Goodman because it is built into the device. In its collapsed form the Goodman is a large box with a handle, which can be a very cumbersome package to carry.

The present invention is a new and improved backpack for simultaneously and comfortably carrying bulk items, such as coolers, folding chairs, and other similar large objects, and loose items that are easily lost, such as wallets, keys, or cellphones. The present invention is designed with a ledge and cargo straps, which together provide an exceptional amount of variety in terms of the number and types of bulk items that can be stowed. The user attachment straps ensure that the weight of the objects stowed on the backpack is adequately supported and distributed on the person using the backpack, allowing for maximum comfort. The present invention substantially diverges in design elements from the prior art and consequently it is clear that there is a need in the art for an improvement to existing cooler and folding chair carrying devices. In this regard the instant invention substantially fulfills these needs.

SUMMARY OF THE INVENTION

In view of the foregoing disadvantages inherent in the known types of cooler and chair carrying devices now present in the prior art, the present invention provides a new backpack ideal for simultaneously carrying bulk items wherein the same can be utilized for providing convenience for the user when seeking to make a single trip while carrying a chair, a cooler, and other items to a desired location during a concert, a sporting event, or another outside event.

It is therefore an object of the present invention to provide a new and improved bulk item carrying device that has all of the advantages of the prior art and none of the disadvantages.

It is another object of the present invention to provide a backpack that is capable of simultaneously carrying a cooler, a folding chair, and other small, loose items.

Another object of the present invention is to provide a backpack that comfortably stores multiple heavy, awkwardly-sized, or otherwise cumbersome objects.

Yet another object of the present invention is to provide a backpack for simultaneously and comfortably carrying a cooler and a folding chair without having said items be built into the backpack, so the user is free to choose whatever chair or cooler that he or she prefers.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
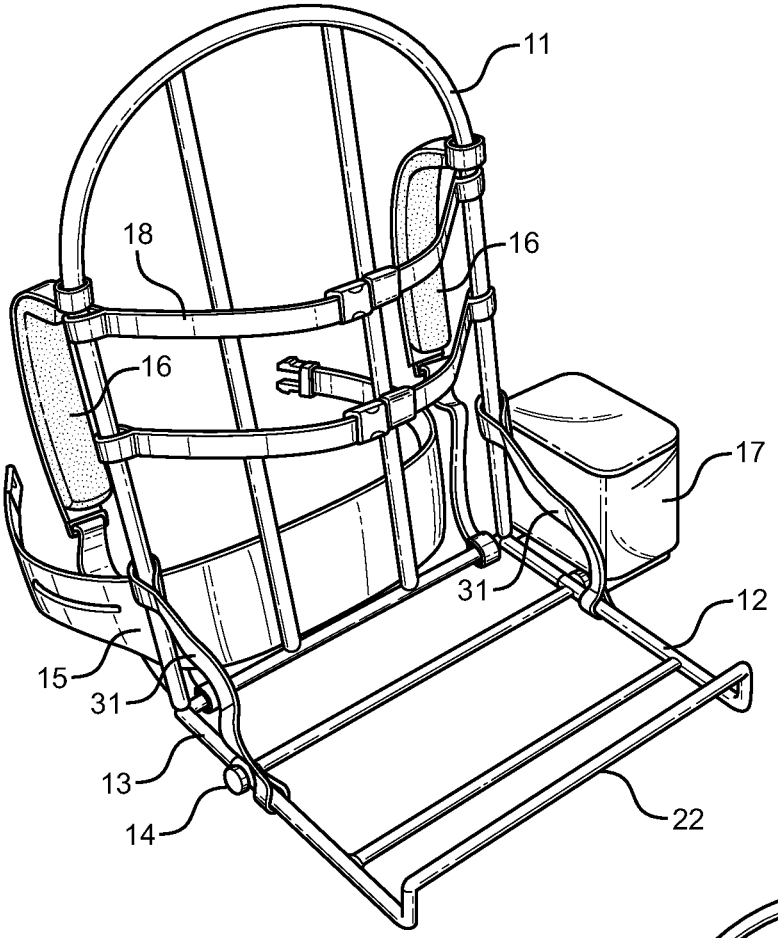
FIG. 1 shows a perspective view of the preferred embodiment of the present invention.

Reference is made herein to the attached drawings. Like reference numerals are used throughout the drawings to depict like or similar elements of the bulk item backpack. For the purposes of presenting a brief and clear description of the present invention, the preferred embodiment will be discussed as used for simultaneously transporting a cooler, a folding chair, and an assortment of small items. The figures are intended for representative purposes only and should not be considered to be limiting in any respect.

Figure 2:
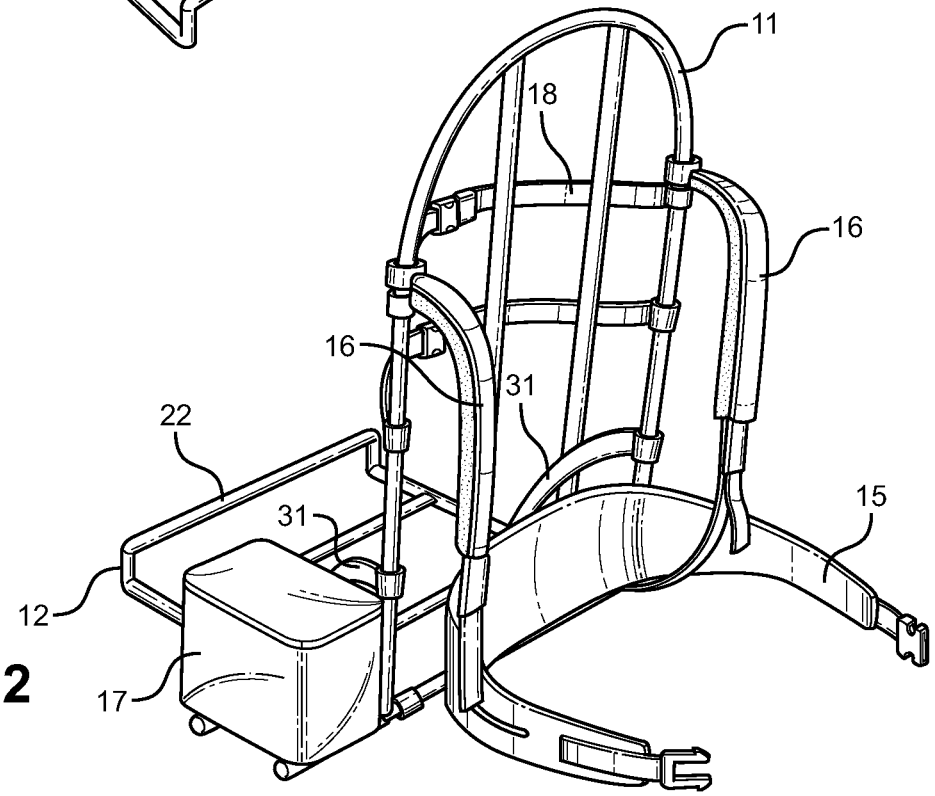
FIG. 2 shows another perspective view of the preferred embodiment of the present invention.

Referring now to FIGS. 1 and 2, there is shown perspective views of the first and second sides of the bulk item backpack of the present invention. The backpack is comprised of an upper frame portion 11 and a lower frame portion 12. The first side of the upper frame portion 11 rests against the back of the user and the second side of the upper frame portion 11 is attached to the lower frame portion 12. The lower frame portion 12 is designed such that it may freely pivot between a position perpendicular to the upper frame portion 11 and a collapsed position parallel to the upper frame portion 11. In the depicted views, a ledge 13 extends outward from the upper frame portion 11, wherefrom the lower frame portion 12 is attached by pivotal connectors 14. This ledge 13 creates space between the upper frame portion 11 and the lower frame portion 12 when the lower frame portion 12 is pivoted into its parallel position, so that the lower frame portion 12 does not physically touch the upper frame portion 11. This space created by the ledge 13 ensures that the upper and lower frame portions 11, 12 do not damage each other when the lower frame portion 12 is pivoted into its collapsed configuration. Alternatively, the lower frame portion 12 may be pivotally connected directly to the upper frame portion 11.

User adjustment straps are attached to the user side of the upper frame portion 11. The user attachment straps adjustably and removably affix the present bulk item backpack to the user so that the user can transport the stowed items. The user attachment straps in the depicted embodiment are a combination of both a waist strap 15 and two shoulder straps 16. Shoulder straps are the standard form of user attachment straps for a backpack, but due to the fact that the present backpack is intended to assist in the transportation of potentially very heavy bulk items, such as coolers, the shoulder straps alone may not be sufficient for support. The waist strap 15 is provided in this embodiment to help with the distribution of weight, which should result in increased stability and comfort for the user while the backpack is in use. The user adjustment straps are adjustable so as to accommodate people of many different sizes and heights. This disclosure contemplates embodiments that have any type of user attachment straps and it is not desired to limit the invention to merely a waist strap and shoulder straps.

The lower frame portion 12, either with or without the ledge 13 attached depending on the embodiment, may be used to store any type of bulk item that be placed thereon, such as a cooler or box. The lower frame portion 12 has a substantially flat surface that provides a versatile means for conveniently supporting a wide array of items thereon. The lower frame portion 12, as depicted, comprises a peripheral frame portion with a plurality of bars extending across said frame portion. However, the disclosure should not be read as limiting in any way, as the lower frame portion 12 may be configured in a wide variety of designs that provide an elongated support surface for bulk item carriage.

The outer end of the lower frame portion 12 further comprises an upstanding lip 22 extending vertically therefrom. The lip 22 prevents items stowed on the lower frame portion 12 from sliding off the end thereof during transport. To assist in carrying additional items, a plurality of cargo straps 18 may be adjustably attached to the exterior face of the upper frame portion 11. These cargo straps 19 can secure a wide array of cargo items and their tightness may be adjusted depending on the size of the item sought to be secured.

Figure 3:
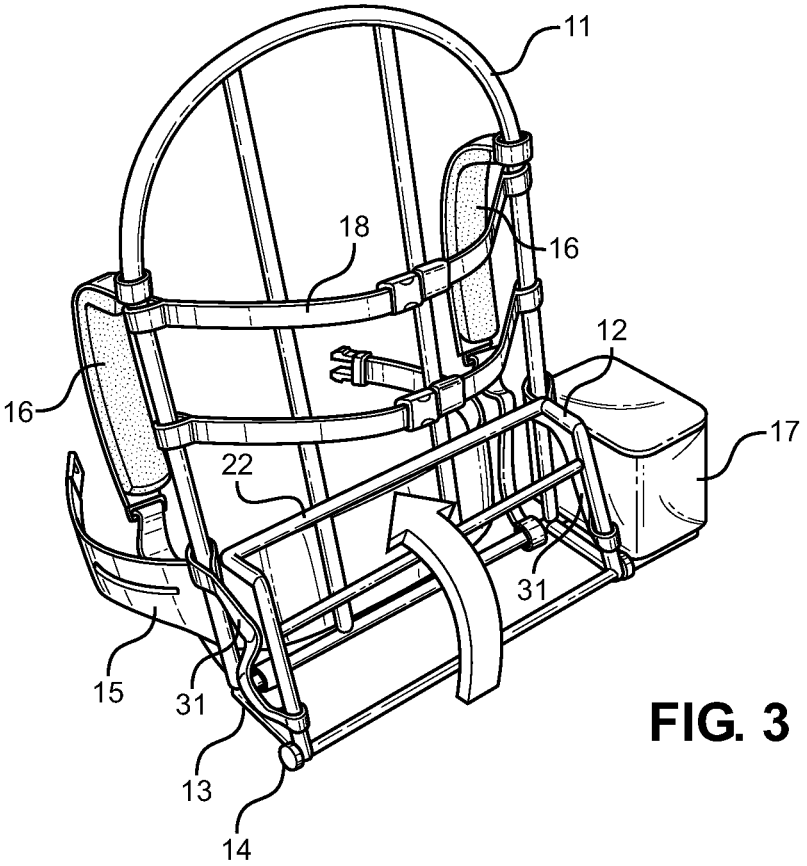
FIG. 3 shows a view of the present invention with the lower frame portion in its collapsed position.

Further assisting in the storage of additional items is a storage box 17, as depicted in FIGS. 1 through 3. The storage box 17 is attached to the upper frame portion 11 and is freely removable. The storage box 17 is adapted to hold loose items, such as keys or a cellphone. The storage box 17 allows the user to conveniently transport loose items while simultaneously carrying a plurality of bulk items, which is normally difficult under most circumstances without any additional assistance.

The upper frame portion 11 is substantially rectangular in shape with a rounded upper end, but no specific shape is claimed as to the design of the upper frame portion 11. The upper frame portion 11 is adapted to fit around and against a user's back. The upper frame portion 11 need only be designed such that it is an upright frame portion capable of supporting the lower frame portion 12 or the ledge 13, depending on the embodiment, and the various straps 15, 16, 18, 31 connected thereto. The upper frame portion 11 may additionally be padded on the user side in order to provide additional comfort for the user.

A pair of gusset straps 31 is disposed on either side of the present invention between the upper frame portion 11 and the lower frame portion 12. The gusset straps 31 are composed of any durable, yet flexible material sufficient to support the weight of the transported bulk items. The pivotal connectors 14 connect the ledge 13 to the lower frame portion 12 or, for embodiments lacking a ledge 13, connect the upper frame portion 11 directly to the lower frame portion 12. For embodiments having the ledge 13, the ledge 13 is integrally connected to the upper frame portion 11, not pivotally connected. The pivotal connectors 14 may have a locking mechanism preventing the lower frame portion 12 from pivoting more than ninety degrees measured from the axis of the upper frame portion 11. In place of a locking mechanism contained within the pivotal connectors 14, gusset straps 31 may be provided to prevent the lower frame portion 12 from pivoting beyond a position substantially perpendicular to the upper frame portion 11. The gusset straps 31 are of a given length sufficient to be fully extended and taut when the lower frame portion 12 is substantially perpendicular to the upper frame portion 11, locking the lower frame portion 12 in place and preventing it from pivoting further. The lower frame portion 12 must be prevented from pivoting past a substantially flat, perpendicular position by either integral anchors within the pivotal connectors 14 or the gusset straps in order to properly support bulk items thereon without slippage.

The gusset straps 31 additionally prevent lateral sliding of bulk items stored upon the lower frame portion 12 by providing a barrier along the sides of the present invention. The gusset straps 31 are connected on one end to the upper frame portion 11 and at the other end to the lower frame portion 12, extending therebetween in a straight line when said gusset strap 31 is fully taut. The gusset straps 31 and the lip 22 work together to keep stowed bulk items contained on the present backpack invention and thereby prevent the bulk items from falling off during transport.

Referring now to FIG. 3, there is shown a perspective view of the present invention with the lower frame portion 12 in its collapsed parallel configuration. Depending on the embodiment, the lower frame portion 12 is connected by pivotal connectors 14 to either the upper frame portion 11 itself or the ledge 13. The lower frame portion 12 is collapsible in order to minimize the area that it takes up and therefore make storage of the backpack easier when not in use. The ledge 13 creates space between the upper frame member 11 and the lower frame member 12 when the lower frame member 12 is in its collapsed position, which prevents the upper and lower frame portions 11, 12 from colliding against each other and causing damage to the backpack structure.

Figure 4:
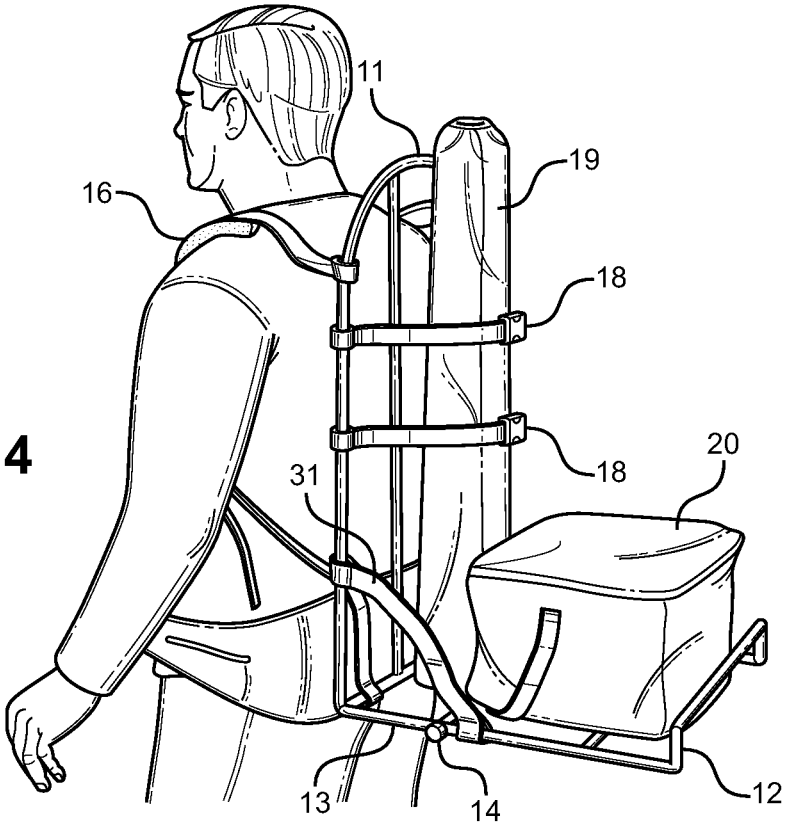
FIG. 4 shows the present invention in use as carried by an individual and supporting items thereon.

Referring now to FIG. 4, there is shown a perspective view of the present bulk item backpack invention demonstrating how it is worn and how bulk items are secured thereto. The depicted embodiment has three user attachment straps, consisting of both a waist strap 15 and shoulder straps 16 that are adjustable to provide maximum weight distribution and comfort to the user. A cooler 20 is resting on top of the lower frame portion 12, which is in its un-collapsed, perpendicular configuration. A folding chair in a bag 19 is secured to the backpack using the cargo straps 18, which are also fully adjustable. Neither the cooler 20 nor the folding chair 21 are part of the present invention, they are merely typical types of bulk items that users of the present invention would seek to transport provided for illustrative purposes.

Users utilize the present bulk item backpack by securing a plurality of bulk items with the cargo straps and placing a plurality of items on the lower frame portion. The cargo straps keep the items stowed therein in a secured position against the exterior face of the upper frame portion. The substantially flat surface of the lower frame portion is suitable for supporting a wide variety of heavy items. Any of the user's loose items can be stored within the storage box connected to the frame of the present invention. Once all of the items to be transported are in place, the user then removably and adjustably secures the present invention to himself or herself via the user attachment straps. When the user finishes using the present invention and all of the stowed items are removed, then the lower frame portion can be collapsed to easily store the present bulk item backpack.

The cooler and chair backpack provides a novel, convenient, and comfortable method to carry multiple heavy, awkwardly-sized, or otherwise cumbersome items at the same time. It can often be extremely difficult or impossible to simultaneously carry the wide-array of items one wishes to have at outdoor events, such as concerts or sporting events, by oneself. The items are either too heavy, are awkward to carry along with other items, or are simply too numerous. Juggling these items while attempting to traverse the often poor ground conditions can lead to perilous situations. Furthermore, it is not possible to make multiple trips to one's destination when alone because the items may be stolen it left alone. The present invention solves all of these problems by providing a flat surface to which coolers and other items may be secured, cargo straps to secure folding chairs and other such items, and a storage bag for securing small items.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A backpack, comprising:

a frame having an upper frame portion, a ledge and a lower frame portion;

wherein said ledge is integrally attached and permanently affixed to a distal end of said upper frame portion having no couples therebetween;

said upper frame portion having a first side and a second side;

said ledge extending outwardly from the distal end of said second side of said upper frame portion, wherein said ledge is permanently perpendicular to said upper frame portion and said ledge creates a space between said upper frame portion and said lower frame portion;

said lower frame portion is pivotably and directly attached to a distal end of said ledge via a pivot;

wherein said lower frame portion may be pivoted between a position parallel to said upper frame portion and a position perpendicular to said upper frame portion, wherein said ledge provides said space between said upper frame portion and said lower frame portion in said parallel position and said perpendicular position;

wherein said lower frame portion in said perpendicular position and said ledge are disposed on a same horizontal plane defining a flat lower side configured to rest flush on a horizontal surface;

a plurality of user attachment straps adjustably attached to said first side of said upper frame portion;

a cross member disposed at a distal end of said ledge, the cross member configured to support an object thereon and within the lower frame portion, wherein the cross member is axially aligned with the pivot.

2. The backpack of claim 1, further comprising a storage box removably attached to said upper frame portion wherein said storage box comprises a base, sidewalls, and an open upper end defining an interior volume adapted for storage of personal items therein.

3. The backpack of claim 1, further comprising a plurality of cargo straps adjustably attached to said second side of said upper frame portion.

4. The backpack of claim 1, further comprising: a storage box removably attached to said upper frame portion;

a plurality of cargo straps adjustably attached to said second side of said upper frame portion.

5. The backpack of claim 1, further comprising a pair of gusset straps extending between said upper frame portion and said lower frame portion, wherein said gusset straps prevent said lower frame portion from pivoting more than 90 degrees.

6. The backpack of claim 2, further comprising a pair of gusset straps extending between said upper frame portion and said lower frame portion, wherein said gusset straps prevent said lower frame portion from pivoting more than 90 degrees.

7. The backpack of claim 3, further comprising a pair of gusset straps extending between said upper frame portion and said lower frame portion, wherein said gusset straps prevent said lower frame portion from pivoting more than 90 degrees.

8. The backpack of claim 4, further comprising a pair of gusset straps extending between said upper frame portion and said lower frame portion, wherein said gusset straps prevent said lower frame portion from pivoting more than 90 degrees.

9. The backpack of claim 1, wherein said lower frame portion further comprises a lip extending vertically upward from an outer end of said lower frame portion so as to help secure an object stored on said lower frame portion when said lower frame portion is in a perpendicular position relative to the upper frame portion.

10. The backpack of claim 1, wherein said lower frame portion and said ledge are attached by pivotable connectors.

11. The backpack of claim 1, wherein the cross member extends between opposing sides of the frame along a same plane as the ledge.

12. The backpack of claim 1, wherein a height of a distal upper end of the upper frame extends further from the ledge than height of a distal upper end of the lower frame.

13. The backpack of claim 1, wherein the backpack is configured to maintain an object in said space between the upper frame portion and the lower frame portion in the perpendicular position, wherein the object is encompassed by the upper frame, the ledge, and the lower frame.

14. A backpack, comprising:

a frame having an upper frame portion, a ledge and a lower frame portion;

wherein the ledge is integrally attached and permanently affixed to a distal end of the upper frame portion having no couples therebetween;

the upper frame portion having a first side and a second side;

the lower frame portion pivotably attached to a distal end of the ledge via a pivot;

wherein the lower frame portion is pivotable between:

an operable position perpendicular to the upper frame portion;

a collapsed position parallel to the upper frame portion and extending in a same direction thereof;

wherein the ledge extends from the distal end of said second side of the upper frame portion and is permanently perpendicular to said upper frame portion;

wherein the operable position the lower frame portion and the ledge are disposed on a same horizontal plane defining a flat lower side configured to rest flush on a horizontal surface;

a plurality of user attachment straps adjustably attached to the first side of the upper frame portion a cross member disposed at a distal end of said ledge, the cross member configured to support an object thereon and within the lower frame portion, wherein the cross member is axially aligned with the pivot.

* * * * *